US005121668A

United States Patent [19]

Segan et al.

[11] Patent Number: 5,121,668

[45] Date of Patent: Jun. 16, 1992

[54] ELECTRONIC GUITAR

[76] Inventors: Marc H. Segan, 20 E. 9th St., New York, N.Y. 10003; Michael Newsome, One Magnolia Ave., Apt. 6, Jersey City, N.J. 07306

[21] Appl. No.: 467,650

[22] Filed: Jan. 19, 1990

[51] Int. Cl.[5] ..... G10H 1/18; G10H 1/36; G10H 5/00; G10H 1/38

[52] U.S. Cl. ..... 84/646; 84/650; 84/669; 84/DIG. 30

[58] Field of Search ..... 84/600, 645-647, 84/649-653, 659, 662, 669, 670, 723, 726, 735, 743, DIG. 30, 613, 637, DIG. 22, 722

[56] References Cited

U.S. PATENT DOCUMENTS

| | | | |
|---|---|---|---|
| 4,295,402 | 10/1981 | Deutsch et al. | 84/DIG. 30 X |
| 4,794,838 | 1/1989 | Corrigan, III | 84/718 |
| 4,817,484 | 4/1989 | Iba et al. | 84/DIG. 30 X |
| 4,919,031 | 4/1990 | Matsumoto | 84/711 X |
| 4,951,546 | 8/1990 | Takabayashi et al. | 84/718 |

OTHER PUBLICATIONS

Operation Manual for Unisynth Electronic Guitar Model No. XG-1 Suzuki Corporation U.S.A.

*Primary Examiner*—William M. Shoop, Jr.
*Assistant Examiner*—Jeffrey W. Daniels
*Attorney, Agent, or Firm*—Cohen, Pontani, Lieberman & Pavane

[57] ABSTRACT

A microprocessor-based electronic guitar generates a music signal for driving an integral speaker. The electronic guitar includes a housing defining a neck and a body, a plurality of manually actuatable strings secured to the body, and a plurality of pushbuttons distributed along the neck, the strings and pushbuttons being operable by the player for controlling the composition of the music signal generated by the microprocessor. The electronic guitar is playable in a chord mode wherein the microprocessor, upon striking the strings, generates a music signal corresponding to chord sounds, a lead mode wherein the microprocessor, upon striking the strings, generates a music signal corresponding to individual notes, and an automatic mode wherein the microprocessor, upon striking the strings, generates a predetermined chord progression defining a stored melody.

47 Claims, 3 Drawing Sheets

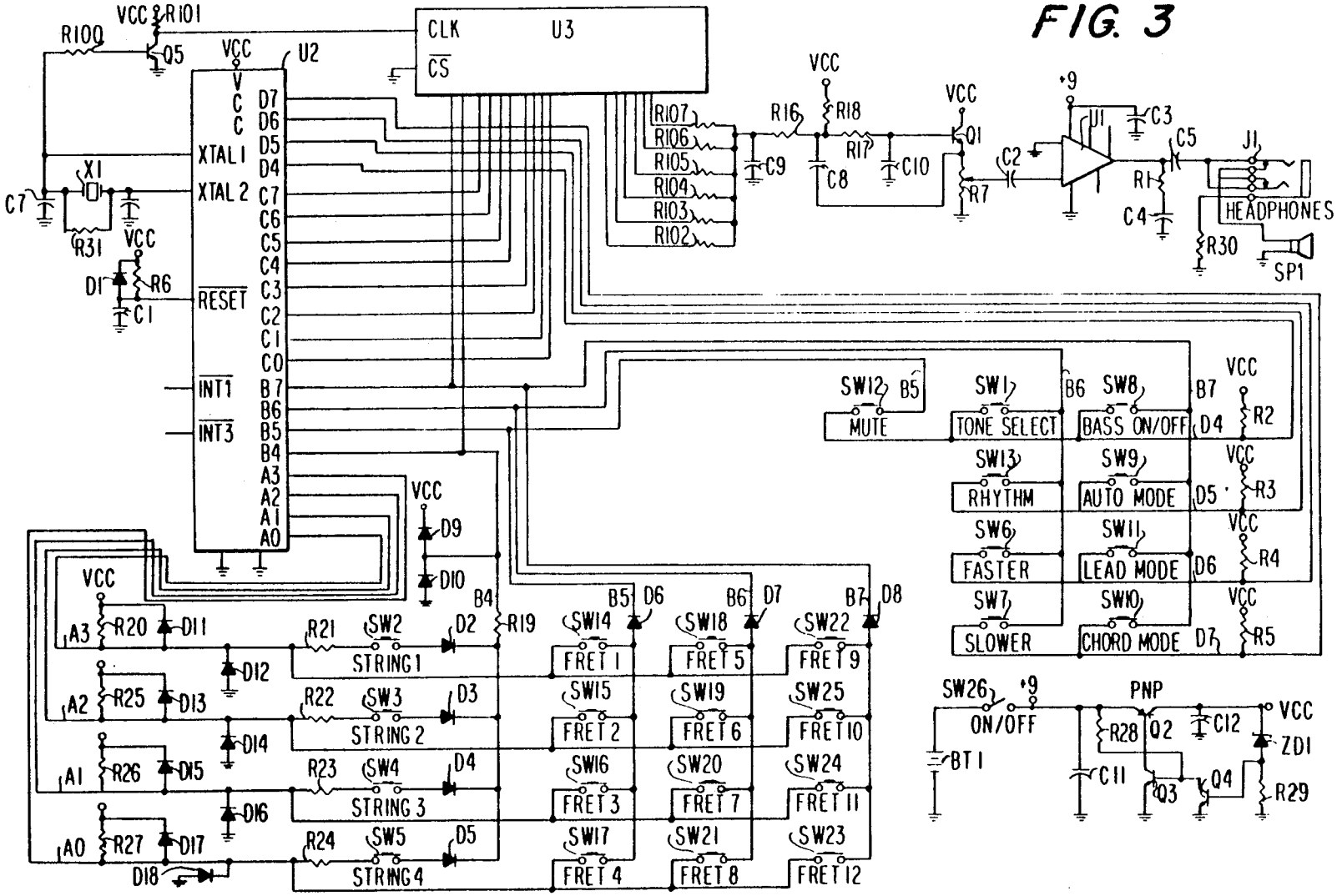
FIG. 3
HEADPHONES
SP1
J1
R30
C5
C3
R1
C4
C2
R7
Q1
VCC
C10
R17
R18
C8
R16
C9
R107
R106
R105
R104
R103
R102
U3
CLK
CS
U2
D7
D6
D5
D4
C7
C6
C5
C4
C3
C2
C1
C0
B7
B6
B5
B4
A3
A2
A1
A0
XTAL 1
XTAL 2
RESET
INT1
INT3
R101
Q5
R100
X1
R31
C7
R6
C1
D1
R2
R3
R4
R5
D4
D5
D6
D7
SW8
BASS ON/OFF
SW9
AUTO MODE
SW11
LEAD MODE
SW10
CHORD MODE
SW1
TONE SELECT
SW13
RHYTHM
SW6
FASTER
SW7
SLOWER
SW12
MUTE
ZD1
R29
C12
Q4
Q2
Q3
R28
C11
PNP
SW26
ON/OFF
BT1
D8
D7
D6
SW22
FRET 9
SW25
FRET 10
SW24
FRET 11
SW23
FRET 12
SW18
FRET 5
SW19
FRET 6
SW20
FRET 7
SW21
FRET 8
SW14
FRET 1
SW15
FRET 2
SW16
FRET 3
SW17
FRET 4
R19
D9
D10
D2
D3
D4
D5
SW2
STRING 1
SW3
STRING 2
SW4
STRING 3
SW5
STRING 4
R21
R22
R23
R24
D12
D14
D16
D11
D13
D15
D17
D18
R20
R25
R26
R27
A3
A2
A1
A0

ELECTRONIC GUITAR

BACKGROUND OF THE INVENTION

1. Field of the Invention

This invention pertains to electronic guitars and more particularly to an electronic toy guitar having a variety of automatic and manually activated features for producing a wide variety of creative musical sounds.

2. The Prior Art

The field of electronic toy guitars is relatively new. The advent of such guitars brings about many new possibilities for children to produce and enjoy music without the necessity of extensive formal training.

One prior art electronic guitar was distributed by Suzuki Corporation USA under the name Unisynth. While the Unisynth incorporates several useful features, it is perceived as overly complex for the target audience, i.e. adolescents, and that complexity has undoubtedly contributed to its lack of success in the marketplace. The Unisynth includes a short string section comprising six strings as on a real guitar and a neck delineating twelve frets, though there are no strings on the neck. Rather, the neck comprises a plurality of touch sensitive actuators. The strings are not acoustic strings; they are actuators, i.e. striking a string generates an electrical pulse proportional to the force with which the string is struck, thereby signaling circuitry inside the body to play the appropriate note.

The Unisynth is playable in several modes, including a manual mode, an auto-chord mode and a demo mode. In the manual mode, the Unisynth is played just like a regular guitar, i.e. by strumming or picking the strings while fingering the appropriate actuators on the neck, which are in the same positions as the strings and frets on the neck of a real guitar, i.e. the Unisynth has six touch sensitive actuators for each fret. In all the modes, repetitive background music is available, the background music consisting of bass accompaniment and one of a plurality of percussion rhythms, the tempo of the background music being adjustable via a control knob on the body of the guitar. Also available in all modes are bass accompaniment and instrument "voice" selections for varying the sounds produced by the strings.

In the auto-chord mode, a chord is selected by fingering the appropriate fret and string position on the neck of the guitar and then strumming the strings on the body of the guitar. That is, the root of the chord is selected by first locating the appropriate fret, whereupon the type of chord, e.g major, minor, 7th, etc., is selected by fingering the appropriate string position on that fret, with the top string position selecting major chords, the next string position minor chords, and so on. It will be apparent, however, that this arrangement requires using the fingers on one hand to choose both the appropriate fret and string position for the desired chord, a task unique to the Unisynth and requiring a high level of manual dexterity, and these are perceived as major drawbacks of the Unisynth. Once a chord is selected, the user may remove his/her hand from the neck of the guitar and the selected chord will continue to play whenever the guitar is strummed, until a new chord is selected by depressing a different actuator on the neck of the guitar.

In the demo mode, the guitar automatically plays the rhythm and bass for the demo song. The user's sole input is to strum the strings, which are automatically tuned to the correct chord. So, as the user strums the strings, he automatically plays the correct chord progression for the demo song. In this mode, the actuators on the neck of the guitar are inoperative—pressing them has no impact on the chord played when the strings are strummed.

The Unisynth also has separate tremolo and mute buttons, each of which is effective in all modes, the former wavering the pitch of the string music, the latter muting the note duration of the tones played by the strings.

It is, therefore, an object of the present invention to provide an electronic guitar having a variety of modes and sounds sufficient for maintaining the interest of both adolescents and adults, but which is nevertheless relatively simple to operate and master, even for adolescents.

A further object of the present invention is to provide an electronic guitar having sufficient versatility and quality to both maintain the creative interests of the player and to entertain a listening audience.

Another object of the invention is to provide an electronic guitar having several automatic and manually activated features which interact with a microprocessor inside the body of the guitar to produce a wide variety of musical sound combinations.

It is yet a further object of the invention to provide a toy musical instrument which is easy to play and yet which has real music validity, i.e. is related in many ways to a real guitar, such that the toy guitar also serves as a learning tool for playing a real guitar.

SUMMARY OF THE INVENTION

To facilitate a proper understanding of the following description, certain musical terms will now be defined. As used herein "note" means a musical sound defined by its pitch and duration; the "type" or "variation" of a chord refers to whether it is a major, minor, diminished, etc.; the "root" of a chord is the note upon which a chord is built and the only note common to all chord variations having that root; "bass line" means a series of low pitched notes harmonically coordinated with the balance of the musical sounds produced by the guitar; "rhythm style" means a specific repeating pattern of percussion sounds having a style such as bossa nova, rap, waltz, etc., which may include a bass line; and "song style" means a sequence of chords having a song structure and accompanied by a background rhythm and bass line specific to that song structure.

Broadly speaking, the electronic guitar in accordance with the present invention generates a music signal for driving a speaker or the like and comprises a housing defining a neck and a body; a plurality of manually actuatable strings secured to the body; means secured to the housing and responsive to actuation of one or more of the strings for generating, in a chord mode, a music signal comprising a first music signal component corresponding to one of a plurality of chord sounds, each of said chords being defined by a chord root and a chord type; a plurality of manually actuatable means connected to the music signal generating means and distributed along the neck for selecting, in the chord mode, the chord root of the first music signal, each manually actuatable means corresponding to a different chord root, actuation of one of the manually actuatable means selecting the corresponding chord root as the chord root of the first music signal component; and means responsive to actuation of the strings for selecting, in the chord mode, the chord type of the first music signal component, at least two of the strings corresponding to different types, actuation of one of said at least two strings selecting the corresponding chord type as the chord type of the first music signal component when one of the manually actuatable means is actuated. Once a chord is selected, a new chord root is easily selected by simply depressing one of the manually actuatable means on the neck of the guitar, or a new root and chord type (e.g. major, minor, etc.) is selected by simply striking the appropriate string while one of the manually actuatable means is depressed.

In accordance with a preferred embodiment of the invention, the means for generating a music signal further comprises, in a lead mode, means for generating a music signal comprising a second music signal component corresponding to one of a plurality of notes; at least two of the strings, and preferably all of them, corresponding to different notes, with actuation of a string in the lead mode selecting the corresponding note as the note of the second music signal component; and first switch means on the housing for switching the music signal generating means between the chord mode and the lead mode. In the lead mode, the pitch of the notes may be varied by depressing one of the manually actuatable means on the neck, thereby closely simulating the play of a conventional guitar.

In the most preferred embodiment, the music signal generating means also comprises, in an automatic mode, means for generating a music signal comprising a third music signal component corresponding to a predetermined progression of chord sounds; and means responsive to actuation of at least one of the strings for causing the music signal generating means to generate, in the automatic mode, the appropriate sound of the predetermined progression; and wherein the first switch means comprises means for selecting as between the chord mode, the lead mode and the automatic mode. In the automatic mode, the key of the chord progression is varied by simply depressing one of the manually actuatable means on the neck of the guitar.

The preferred electronic guitar in accordance with the present invention incorporates several additional features, including, to name a few, the ability to generate background percussion rhythms; a tempo control for varying the tempo of the background rhythm; a bass line playable in conjunction with the chord mode and the automatic mode; and a sound switch for varying the type of sound generated by the electronic guitar. These as well as further features and advantages of the electronic guitar in accordance with the present invention will be more fully apparent from the following detailed description and annexed drawings of the presently preferred embodiment thereof.

BRIEF DESCRIPTION OF THE DRAWINGS

In the drawings:

FIG. 3 is a schematic view of the circuitry for the guitar of the present invention.

DETAILED DESCRIPTION OF THE PREFERRED EMBODIMENT

Figure 1:
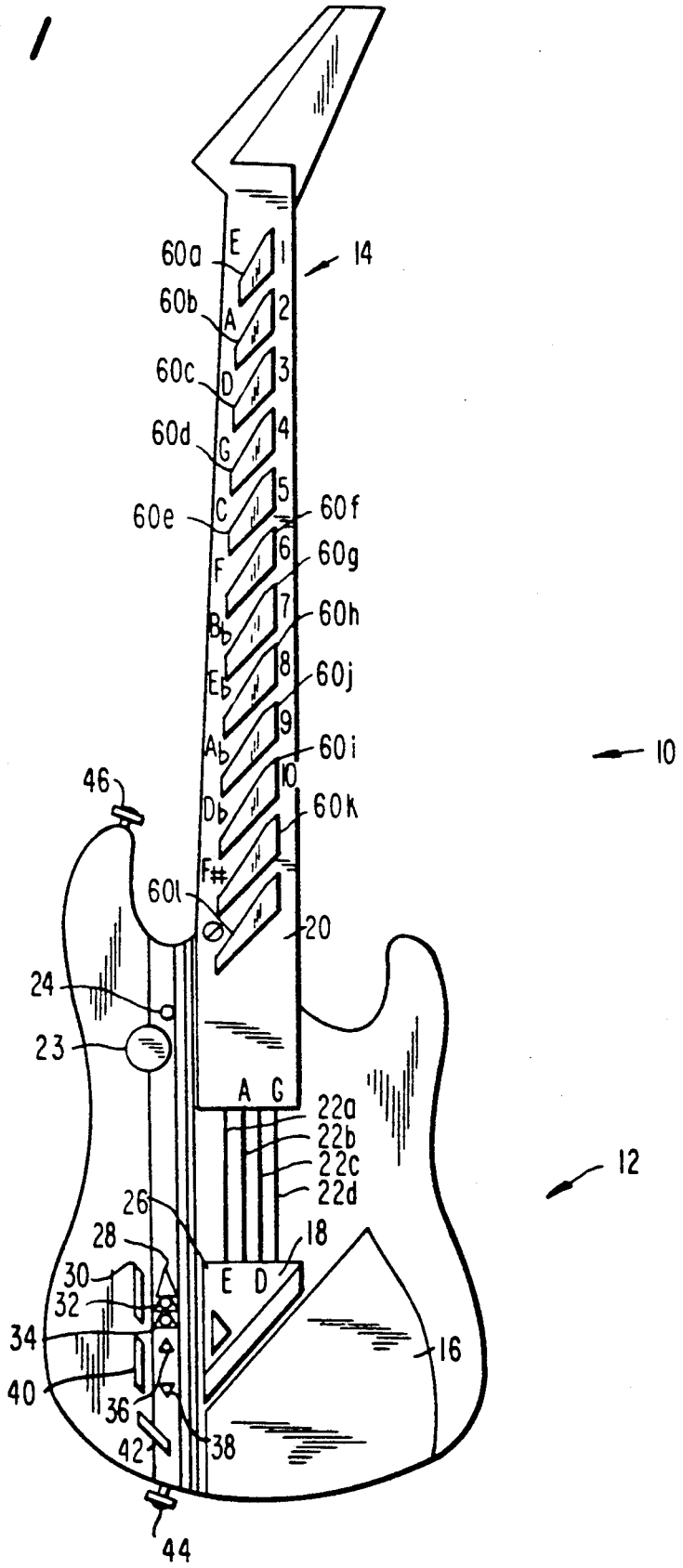
FIG. 1 is a plan view of the electronic guitar of the present invention.

Referring now to the drawings and initially to FIG. 1 thereof, the electronic toy guitar in accordance with the present invention, generally designated by the reference numeral 10, has a body 12 and a neck 14. Incorporated in the body 12 are a speaker 16 and upper and lower bridges 18 and 20, respectively, the bridges securing the ends of the four strings 22*a*–22*d*. As will be more fully explained below, and starting with the leftmost string 22*a* in FIG. 1, the strings 22 are electronically tuned to notes E, A, D and G and are arranged in the same order as the bottom four strings of a real guitar to add to the musical validity of the guitar 10. Also incorporated on the body 12 and more fully described below are a variety of controls for the guitar 10, including a knob 23 for turning power to the guitar 10 on and off and for adjusting the volume of sound played by speaker 16, a power on-off indicator light 24, a "wa wa" button 26 on the bridge 18, an auto button 28, a bass on/off button 30 a chord button 32, a lead button 34, tempo buttons 36 and 38, a rhythm button 40 and a sound button 42. Incorporated on the neck 14 are twelve fret buttons 60*a*–60*l*, each representing a different musical chord as identified by the notes distributed along the length of the neck. Strap posts 44 and 46 on the body 12 are for optional attachment of a guitar strap (not shown).

Figure 2:
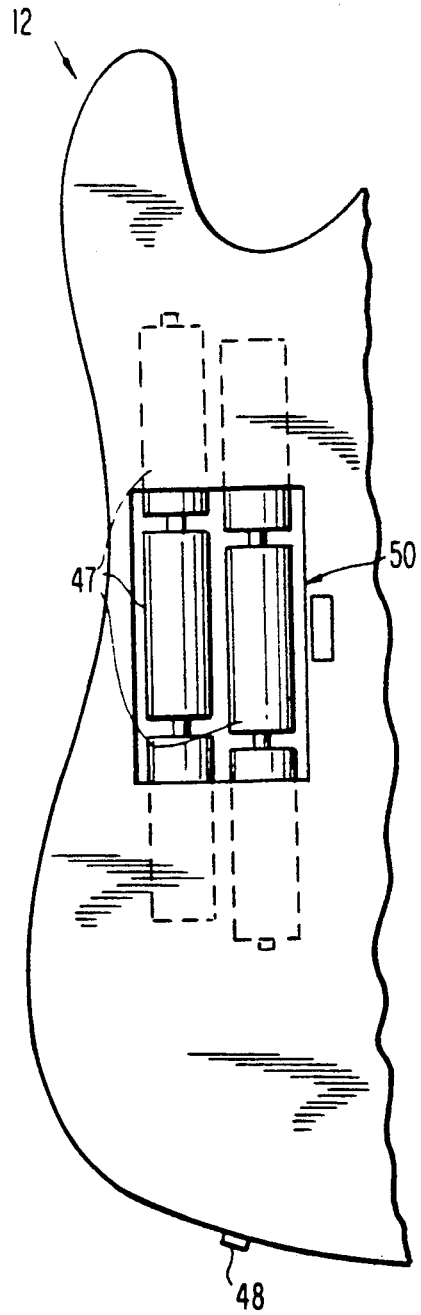
FIG. 2 is a partial view of the guitar body, with portions shown in phantom.

As best shown in FIG. 2, power for the guitar 10 is supplied by six "C" batteries 47 housed in battery compartment 50 accessible by a removable door (not shown). Also shown in FIG. 2 is an output jack 48 for optionally outputting sound from the guitar 10 through headphones. If desired, the jack 48 may be used for outputting the sound from the guitar 10 to an external amplifier.

The guitar 10 may be played in any one of three modes, namely, a chord mode, a lead mode and an automatic mode. When the guitar is first turned on via knob 23, it is in the chord mode, and after switching to one of the other modes, the chord mode may be reactivated by depressing the chord button 32. In the chord mode, the guitar 10 plays a true musical chord each time one or more of the strings 22 is strummed. To select a chord, the user selects one of the twelve chord roots represented by the musical notes on the neck 14 by depressing the appropriate fret button 60 and then, with the button 60 depressed, simultaneously strumming one of the strings 22. Depending upon which string is strummed, and viewing the strings 22 from left to right in FIG. 1, one of the following four types of the chord root will be selected: major, minor, seventh or diminished. So, for example, pressing the topmost button 60*a* while strumming the leftmost string 22*a* will select an E major chord, pressing the third button 60*c* form the top while strumming the rightmost string 22*d* will select a diminished D chord, etc. Once a root and chord type have been selected and the fret button released, any time one or more of the strings 22 is strummed, the guitar 10 will play the selected chord. At any time, a new root may be selected by simply depressing a different fret button 60, whereupon strumming the strings 22 will play the new chord in the same type as the previous root. So, for example, if an E major chord had been selected, and the user now depresses the fret button 60*c* corresponding to a D chord root and releases it before the strings are strummed, strumming the strings 22 will now play a D major chord. Of course, at any time, the user can select a new type of chord by repeating the procedure described above for initially selecting a chord, i.e. depressing the fret button 60 corresponding to the desired chord root while simultaneously strumming the string 22 corresponding to the desired chord type, namely, major, minor, seventh or diminished. It will therefore be apparent that if a fret button is held down, each chord type of the selected root may be played by simply striking the appropriate string. That is, for example, if the user selects an E chord root by holding down the fret button 60*c*, he can play an E major, minor, seventh and diminished by striking, respectively, the strings 22*a*, 22*b*, 22*c* and 22*d*. It should be appreciated that this arrangement simulates a real guitar wherein musical sounds are generated by first selecting a fret by depressing strings on the neck of the guitar and then striking the appropriate strings with the other hand.

The rhythm button 40, in combination with the fret buttons 60, is used for selecting background percussion rhythm styles. Background percussion is always present in the automatic mode and is optional in the chord and lead modes. The desired rhythm style is selected by first holding down the fret button 60 corresponding to the desired rhythm style and then depressing the rhythm button 40 while continuing to hold down the selected fret button. If the rhythm button 40 is depressed without depressing one of the frets, the guitar selects the last rhythm played. If rhythm has not been played since the guitar was turned on, a default rhythm style, which in the preferred embodiment is the rhythm style corresponding to the fret button 60*a*, is automatically selected.

A total of ten different rhythm styles are available, as indicated by the numbers 1–10 next to the first ten fret buttons 60*a*–60*j*, the latter two fret buttons 60 having no rhythm function. In the preferred embodiment the available rhythm styles are Swing, 8th Note Rock, Dance, Funk, Latin, 12/8 Ballad, Pop Rock Ballad, Detroit, Heavy Metal and Rap, though other rhythm styles may be substituted. Once a rhythm style is selected, it continues to play until the rhythm button 40 is again depressed, whereupon the current rhythm style is discontinued. Pressing the rhythm button again, while no fret buttons are depressed, reactivates that rhythm style. If a new rhythm style is desired, the appropriate fret button 60 is first depressed and, while the fret button is held down, the rhythm button 40 is also depressed. In the chord mode, depressing the fret also signals a new chord root, so if a fret is depressed and then the rhythm button 40 is pressed while the fret button is still held down, thereby indicating that the player wishes to select a new rhythm style, the guitar preferably sets the selected chord root and type to a default setting, i.e. E major. There is no disadvantage to this arrangement, since a change in the rhythm style is, in any event, invariably followed by a change in the chord root and type. The tempo buttons 36 and 38 serve to speed up and slow down, respectively, the tempo of the background rhythm. Each time these buttons are depressed, the tempo is sped up or slowed down, as the case may be, by a predetermined amount. So, for example, to slow the tempo by a small amount, the button 38 would be depressed once, whereas to slow it considerably, the button 38 would be depressed several times.

The automatic mode of the guitar 10 is selected by depressing the auto button 28. Thereafter, the user selects the song style to be played by depressing one of the ten fret buttons 60*a*–60*j* for selecting among the ten song styles stored in the memory of the microprocessor inside the body of the guitar. The music is then started by depressing rhythm button 40 whereupon the guitar automatically selects and plays the rhythm style appropriate for the selected song style, comprising a percussion background and an appropriate bass accompaniment. Then, as the player strums one or more of the strings 22, the guitar automatically plays the proper chords for the selected song style. However, precisely because the chords are played only when the strings 22 are strummed, it still appears that the user is really "playing" the guitar. Once a song style is activated in the automatic mode, the key of that song style may be changed by depressing one of the fret buttons 60. More particularly, each song style has an initial, predetermined key corresponding to the fret button 60*a*. The key of that song style may then be increased in half step increments by depressing one of the fret buttons 60*b*–60*l*, i.e. the button 60*b* raises the key by one half step, the button 60*c* raises the key a full step, etc. At any time the original, predetermined key may be selected by simply depressing the button 60*a*. So, it will be apparent that in the automatic mode the user's control is limited to selection of the key and activation of the chords by strumming the strings 22.

Depressing lead button 34 selects the lead mode of the guitar 10. In the lead mode the user selects the song style by playing one note at a time, just like a lead guitarist. As noted above, the four strings 22 are arranged in the same order as the bottom four strings of a real guitar. That is, as viewed from left to right in FIG. 1, the notes played by the strings 22*a*–22*d* in the lead mode are E, A, D and G. In the lead mode, the fret buttons 60 are used to change the pitch of the notes, also as on a real guitar. As on a real guitar, the frets are half a step apart, i.e. moving from one fret button 60 to an adjacent one varies the pitch of the selected note by half a step, starting with the fret button 60*a*, e.g. striking the E string 22*a* while depressing fret button 60*a* raises the pitch of the E note by one half step, i.e. to an F note, striking the E string while depressing fret button 60*b* raises the original pitch by one full step to an F sharp, and so on. Of course, if the strings are struck without depressing any button 60, the strings 22*a*–22*d* play the notes E, A, D and G. It should be noted that four strings are preferred, rather than six as on a conventional guitar, as children and other novices will find four strings easier to handle. Also, to the extent that four strings limits the guitar 10 to four chord types, four chord types have been found sufficient for playing such a wide variety of music as not to constitute a limitation.

The sound button 42 selects the "sound" of the guitar 10 from among electric, echo, or synthesized. The desired sound is selected by striking one or more strings while repeatedly pressing the button 42 until the desired sound is heard, as repeated pressing of the button 42 cycles the guitar 10 through its available sounds.

The bass on/off button 30 may be used in the chord or automatic modes. In the chord or automatic mode, selecting a rhythm style via button 40 automatically selects an appropriate bass line consisting of a series of bass notes in harmony with the selected rhythm style. If the guitar is in the automatic mode, the bass line is automatically selected to be in harmony with the key of the song style, and if the player depresses one of the fret buttons 60 to change the key, the key of the bass line is automatically changed to correspond with the new key. Similarly, in the chord mode, as new chords are played, the key of the bass line is automatically changed to follow the root of the new chord. In either mode, the bass line may be dropped from the rhythm style by depressing the button 30, and reactivated by again depressing the button 30. The bass line is not available in the lead mode, as there is no way to insure harmony between the lead notes and the bass line.

The button 26 serves two functions, depending on which mode the guitar 10 is in. In the lead mode, depressing the button 26 "bends" the pitch of the note played creating the familiar "wa wa" effect. In the automatic and chord modes depressing the button 26 functions as a mute switch; depressing it while a chord is sounding silences the chord, producing a muting effect. Note that the button 26 is positioned on the lower bridge 18 where it can be depressed with the heel of the hand without interrupting play.

From the foregoing description, it will be apparent that the guitar 10 in accordance with the present invention is capable of generating a wide variety of different musical sounds in a number of different modes, each of which is different from the others in terms of ability required. Moreover, by simply manipulating the strings 22 and the pushbuttons 60, a number of musical functions are controlled, and such control is effected in a manner which simulates a conventional guitar while requiring significantly less manual dexterity. When the additional features of the guitar 10 are taken into account, e.g. rhythm styles with or without bass lines, tempo control, etc., it is apparent that the guitar 10 will be thoroughly enjoyed by the target audience.

FIG. 3 schematically illustrates the circuitry for the guitar 10, all of which is situated inside the housing of the guitar. As shown, the circuit for the guitar 10 includes a programmable microprocessor U2 and a digital sound generator U3. The output from U3 is a group of analog signals which is summed, filtered, amplified and input to speaker 16 for producing audible sounds.

Referring to the schematic of FIG. 3 in detail, X1, C8, C12 and R31 comprise a tuned circuit for setting the clock frequency of the microprocessor U2. Through R100, R101 and Q5 the clock frequency is also applied to U3. D1, R6 and C1 comprise a reset circuit for resetting the microprocessor U2 to an initial state when power is applied. As shown, the digital outputs from the "C" ports of U2 are input to U3 for conversion to corresponding analog waveforms. The analog signals output from U3 are summed by the mixer circuit comprised of R102-107. Digital noise on the summed analog signal is removed by a filter circuit comprised of R16, R17, R18, C7, C8, C9 and Q1. Audio amplifier U1 in combination with C2, C3, C4, C5, and R1 comprise an amplifier circuit for boosting the power level of the summed analog signal to a level sufficient to drive the speaker 16. Variable resistor R3 on the input side of U1 comprises the volume control portion of control 23 on the body 12 of guitar 10. As shown, the amplified signal output from U1 is also applied to a conventional jack 48 for optionally listening through headphones, the power driving the headphones being reduced by R30.

The circuit is powered by batteries 47, preferably six "C" batteries collectively supplying 9 volts. SW26 turns power to the guitar 10 on and off. SW26 in combination with variable resistor R7 comprises the control 23. Q2, Q3 and Q4 in combination with C10, C11, R28 and D19 comprise a voltage regulator circuit providing a stable voltage between 5.5 and 6.0 volts for powering the associated circuit.

The control switches which inform the microprocessor U2 which functions the user has selected are pushbuttons 26, 28, 30, 32, 34, 36, 38, 40, and 42. The pull-up resistors R2, R3, R4 and R5 allow the state of these control switches to be read by U2 in a manner more fully described below. Similarly, the control switches which inform the microprocessor U2 which fret, if any, has been selected, and which string, if any, has been struck, are pushbuttons 60*a*-60*l* and switches 22*a*-22*d*, respectively. In this regard, strings 22 are, in reality, contact switches, i.e. each time a string is struck and released by the player, it closes and opens, respectively, the contacts schematically illustrated in FIG. 3. R20, R25, R26 and R27 are pull-up resistors which allow the state of control switches 22 and 60 to be read by U3. D9-D18, R19, and R21-R24 comprise a protection circuit for preventing static discharge to the strings 22 from damaging the microprocessor U3. As will be more fully apparent as this description progresses, D2-D8 are isolation diodes which allow the state of switches 22 and pushbuttons 60 to be read simultaneously and unambiguously by U2.

The manner in which the microprocessor U2 reads the states of the various controls 22*a*-22*d*, 26, 28, 30, 32, 34, 36, 38, 40, 42 and 60*a*-60*l* will now be explained. Lines B4-B7 of U2 output a repetitive binary code consisting of three high bits and one low bit. In other words, the binary codes 1110, 1101, 1011 and 0111 are sequentially output from the B ports of U2, the sequence being repeated several thousand times per second. Consequently, at any given time, one of the output lines B4-B7 is at ground and the other three are at Vcc.

Lines D4-D7 are used as inputs to read the status of pushbutton controls 26, 28, 30, 32, 34, 36, 38, 40 and 42. It will be apparent from FIG. 3 that if none of these pushbuttons is pressed, the pull-up resistors R2-R5 cause each of the inputs D4-D7 to "see" Vcc, i.e. each of the inputs D4-D7 is read as a logic one by U2, which indicates to U2 that none of the pushbuttons 26, 28, 30, 32, 34, 36, 38, 40, or 42 has been depressed. Now, if, for example, the pushbutton 30, i.e. the bass line control, is depressed, contact is established between input line D4 and output line B7. If B7 is high, i.e. at Vcc, D4 will remain at VCC and U2 will continue to read a logic one at that input, which, as far as U2 is concerned, indicates that pushbutton 30 has not been depressed. However, as the output code cycles and B7 goes low, it pulls D4 to ground, which causes U2 to read a logic zero at D4, thereby indicating to U2 that pushbutton 30 is depressed whereupon U2 generates from its memory the digital signal corresponding to the appropriate bass line and outputs it via one of C0-C7 to U3. Since when the output from B7 is low, B4, B5 and B6 are high, U3 recognizes that its low input at D4 is due to pushbutton 30 being depressed, since if instead pushbuttons 26 or 42 were depressed, the high outputs at B5 and B6, respectively, would cause U2 to read a high output at D4. But, since U2 reads a low input at D4, it can only be due to closing of pushbutton 30.

It should by now be apparent that input lines A0-A3 to U2 read the status of strings 22*a*-22*d* and frets 60*a*-60*l* in much the same manner that input lines D4-D7 read the status of control 26, 28, 30, 32, 34, 36, 38, 40 and 42. Thus, if no string 22 has been struck and no fret 60 depressed, pull-up resistors R20 and R25-R27 cause all of the inputs A0-A3 to read VCC, regardless of the status of the outputs from B4-B7. If then, for example, the string 22*a* is struck, the output from B4 is applied through isolation diode D2 to input A3. As long as B4 is high, A3 will continue to read Vcc. However, when B4 goes low, A7 is pulled low through isolation diode D2, which indicates to U2 that string 22*a* has been struck. Of course, if several strings are struck simultaneously, e.g. if strings 22*a*, 22*b* and 22*c* are struck simultaneously, whenever B4 is low their corresponding inputs to U2, namely, A3, A2 and A1 respectively, will all be low, i.e. logic zero, such that U2 recognizes that all of these strings have been struck. Also, when B4 is low, B5, B6 and B7 are all high, such that U2 recognizes that a low input at ports A0–A3 must be due to one of the strings 22 being struck. That is, depressing one of the frets 60 while B4 is low will have no impact on the input ports A0–A3, which will continue to see Vcc unless one of the strings 22 is struck, since all of the output lines to the frets 60*a*–60*d*, i.e. B5–B7, are high. It will therefore be apparent that the status of the frets 60 is also read by input ports A0–A3 when their corresponding inputs from output ports B5–B7 go low. So, for example, if fret 60*e* is depressed, input port A7 is pulled low whenever B6 goes low, thereby indicating to U2 that fret 60*e* has been depressed, whereas whenever B6 is high, the input to A7 will also be high, unless string 22*a* is struck and B4 is low, fret 60*a* is depressed and B5 is low, or fret 60*i* is depressed and B7 is low, in which event the input to A7 will be high, with U2 recognizing which of string 22*a*, fret 60*a*, 60*e* or 60*i* is being read by virtue of the status of the binary code output from B4–B7, as an A input port can only go low only when it is connected to the low B output port.

It will therefore be apparent that as the binary code output from B4–B7 is cycled, U2 continuously reads the status of the strings 22*a*–22*d*, controls 26, 28, 30, 32, 34, 36, 38, 40 and 42, and the frets 60*a*–601 by SCanning the input levels to ports A0–A3 and D4–D7. As noted, the binary code output at B4–B7 is cycled several thousand times per second, such that U2 is constantly updating the status of all its inputs. Also, this high cycle rate insures that activation of the strings, frets or controls will not be "missed" by U2, which could occur only if activation takes place solely while the corresponding B port is high.

Of course, the microprocessor U2 is programmed to generate the appropriate music signals at the outputs C0–C7 depending on the status of its inputs at A0–A3 and D4–D7, with these inputs, and hence the outputs at C0–C7, being continuously updated to reflect the status of strings 22, controls 26, 28, 30, 32, 34, 36, 38, 40 and 42, and frets 60 at any given point in time. Programming of the microprocessor U2 to generate outputs at C0–C7 in response to the inputs at A0–A3 and D4–D7 for achieving the musical sounds called for by the strings, controls and frets being well within the capabilities of the person of ordinary skill in the art, a further description thereof is deemed unnecessary.

A parts list for the circuit of FIG. 3 is set forth below in Table 1.

TABLE 1

| Part | Function/ Value | Description |
|---|---|---|
| C1 | 4.7 UF | +80%,−20%, 16 Volt Aluminum Electrolytic Capacitor |
| C2 | 100 NF | +/−10%, 25 Volt, Ceramic Disk Capacitor |
| C3 | 100 UF | +80%,−20%, 16 Volt Aluminum Electrolytic Capacitor |
| C4 | 47 NF | +/−10%, 25 Volt, Ceramic Disk Capacitor |
| C5 | 220 UF | +80%,−20%, 16 Volt Aluminum Electrolytic Capacitor |
| C6 | 68 PF | +/−10%, 25 Volt, Ceramic Disk Capacitor |
| C7 | 3.9 PF | +/−10%, 25 Volt, Ceramic Disk Capacitor |
| C8 | 33 NF | +/−10%, 25 Volt, Ceramic Disk Capacitor |

TABLE 1-continued

| Part | Function/ Value | Description |
|---|---|---|
| C9 | 560 PF | +/−10%, 25 Volt, Ceramic Disk Capacitor |
| C10 | 100 NF | +/−10%, 25 Volt, Ceramic Disk Capacitor |
| C11 | 100 UF | +80%,−20%, 16 Volt Aluminum Electrolytic Capacitor |
| C12 | 47 PF | +/−10%, 25 Volt, Ceramic Disk Capacitor |
| R1 | 10 Ohm | 5%, ¼ Watt, Carbon Film |
| R2 | 22K | 5%, ¼ Watt, Carbon Film |
| R3 | 22K | 5%, ¼ Watt, Carbon Film |
| R4 | 22K | 5%, ¼ Watt, Carbon Film |
| R5 | 22K | 5%, ¼ Watt, Carbon Film |
| R6 | 22K | 5%, ¼ Watt, Carbon Film |
| R7 | 10K | Potentiometer - Volume control |
| R16 | 100K | 5%, ¼ Watt, Carbon Film |
| R17 | 51K | 5%, ¼ Watt, Carbon Film |
| R18 | 100K | 5%, ¼ Watt, Carbon Film |
| R19 | 4.7K | 5%, ¼ Watt, Carbon Film |
| R20 | 100K | 5%, ¼ Watt, Carbon Film |
| R21 | 4.7K | 5%, ¼ Watt, Carbon Film |
| R22 | 4.7K | 5%, ¼ Watt, Carbon Film |
| R23 | 4.7K | 5%, ¼ Watt, Carbon Film |
| R24 | 4.7K | 5%, ¼ Watt, Carbon Film |
| R25 | 100K | 5%, ¼ Watt, Carbon Film |
| R26 | 100K | 5%, ¼ Watt, Carbon Film |
| R27 | 100K | 5%, ¼ Watt, Carbon Film |
| R28 | 560 Ohm | 5%, ¼ Watt, Carbon Film |
| R29 | 10K | 5%, ¼ Watt, Carbon Film |
| R30 | 7.5 Ohm | 5%, ¼ Watt, Carbon Film |
| R31 | 1M | 5%, ¼ Watt, Carbon Film |
| R100 | 1K | 5%, ¼ Watt, Carbon Film |
| R101 | 10K | 5%, ¼ Watt, Carbon Film |
| R102 | 330K | 5%, ¼ Watt, Carbon Film |
| R103 | 330K | 5%, ¼ Watt, Carbon Film |
| R104 | 330K | 5%, ¼ Watt, Carbon Film |
| R105 | 330K | 5%, ¼ Watt, Carbon Film |
| R106 | 330K | 5%, ¼ Watt, Carbon Film |
| R107 | 330K | 5%, ¼ Watt, Carbon Film |
| Q1 | MPSA06 | Silicon small-signal NPN Transistor |
| Q2 | MPSA06 | Silicon small-signal NPN Transistor |
| Q3 | MPSA06 | Silicon small-signal NPN Transistor |
| Q4 | MPSA06 | Silicon small-signal NPN Transistor |
| Q5 | MPSA06 | Silicon small-signal NPN Transistor |
| D1 | 1N4148 | 50 PIV, 20 MA, Silicon signal diode |
| D2 | 1N4148 | 50 PIV, 20 MA, Silicon signal diode |
| D3 | 1N4148 | 50 PIV, 20 MA, Silicon signal diode |
| D4 | 1N4148 | 50 PIV, 20 MA, Silicon signal diode |
| D5 | 1N4148 | 50 PIV, 20 MA, Silicon signal diode |
| D6 | 1N4148 | 50 PIV, 20 MA, Silicon signal diode |
| D7 | 1N4148 | 50 PIV, 20 MA, Silicon signal diode |
| D8 | 1N4148 | 50 PIV, 20 MA, Silicon signal diode |
| D9 | 1N4148 | 50 PIV, 20 MA, Silicon signal diode |
| D10 | 1N4148 | 50 PIV, 20 MA, Silicon signal diode |
| D11 | 1N4148 | 50 PIV, 20 MA, Silicon signal diode |
| D12 | 1N4148 | 50 PIV, 20 MA, Silicon signal diode |
| D13 | 1N4148 | 50 PIV, 20 MA, Silicon signal diode |
| D14 | 1N4148 | 50 PIV, 20 MA, Silicon signal diode |
| D15 | 1N4148 | 50 PIV, 20 MA, Silicon signal diode |
| D16 | 1N4148 | 50 PIV, 20 MA, Silicon signal diode |
| D17 | 1N4148 | 50 PIV, 20 MA, Silicon signal diode |
| D18 | 1N4148 | 50 PIV, 20 MA, Silicon signal diode |
| D19 | 1N4148 | 50 PIV, 20 MA, Silicon signal diode |
| U1 | LM386 | Audio Amplifier IC |
| U2 | TMS7000 | Microprocessor |
| U3 | YM2163 | Sound Generator IC |
| SP1 | 8 Ohm | 3" Speaker |
| J1 | ¼" | Stereo Headphone Jack |
| BT1 | 9 V | Battery - 6 "C" cells |
| X1 | 8 Mhz | +/−0.5% Ceramic Resonator |
| SW1 | Control | Metal Dome Switch |
| SW2 | String | |
| SW3 | String | |
| SW4 | String | |
| SW5 | String | |
| SW6 | Control | Metal Dome Switch |
| SW7 | Control | Metal Dome Switch |
| SW8 | Control | Metal Dome Switch |
| SW9 | Control | Metal Dome Switch |
| SW10 | Control | Metal Dome Switch |
| SW11 | Control | Metal Dome Switch |
| SW12 | Control | Metal Dome Switch |

TABLE 1-continued

| Part | Function/ Value | Description |
|---|---|---|
| SW13 | Control | Metal Dome Switch |
| SW14 | Fret | Metal Dome Switch |
| SW15 | Fret | Metal Dome Switch |
| SW16 | Fret | Metal Dome Switch |
| SW17 | Fret | Metal Dome Switch |
| SW18 | Fret | Metal Dome Switch |
| SW19 | Fret | Metal Dome Switch |
| SW20 | Fret | Metal Dome Switch |
| SW21 | Fret | Metal Dome Switch |
| SW22 | Fret | Metal Dome Switch |
| SW23 | Fret | Metal Dome Switch |
| SW24 | Fret | Metal Dome Switch |
| SW25 | Fret | Metal Dome Switch |
| SW26 | On-Off | SPST (part of Volume Control) |

While we have herein shown and described a preferred embodiment of the present invention and suggested certain modifications thereto, persons of ordinary skill in the art will recognize that still further changes may be made therein without departing from the spirit and scope of the present invention. Accordingly, the above description should be construed as illustrative and not in a limiting sense, the scope of the invention being defined by the following claims.

What is claimed is:

1. An electronic guitar for generating a music signal for driving a speaker or the like, comprising:

a housing defining a neck and body;

a plurality of manually actuatable strings secured to the body;

means secured to said housing and responsive to actuation of one or more of said strings for generating, in a chord mode, a music signal comprising a first music signal component corresponding to one of plurality of chords sounds, each of said chords being defined by a chord root and a chord type;

a plurality of manually actuatable means connected to said music signal generating means and distributed along the neck for selecting, in said chord mode, the chord root of said first music signal component, each manually actuatable means corresponding to a different chord root, actuation of one of said manually actuatable means selecting the corresponding chord root as the chord root of the first music signal component;

means responsive to actuation of said strings for selecting, in said chord mode, the chord type of said first music signal component, at least two of said strings corresponding to different chord types, actuation of one of said at least two strings selecting the corresponding chord type as the chord type of the first music signal component when one of the said manually actuatable means is actuated.

2. The electronic guitar of claim 1, wherein said music signal generating means comprises means for generating the selected chord sound upon actuation of any one of said strings.

3. The electronic guitar of claim 1, wherein said means for generating a music signal further comprises, in a lead mode, means for generating a music signal comprising a second music signal component corresponding to one of a plurality of notes; at least two of said strings corresponding to different notes, actuation of either of said at least two strings in said lead mode selecting the corresponding note as the note of the second music signal component; and first switch means on said housing for switching said music signal generating means between said chord mode and said lead mode.

4. The electronic guitar of claim 3, wherein at least two of said manually actuatable means each corresponds, in said lead mode, to a different predetermined variation in the pitch of the note sound of said second music signal component, actuation of one of said at least two manually actuatable means when one of said strings is actuated causing said music signal generating means to vary the pitch of the note sound by the predetermined variation corresponding to the actuated one of said manually actuatable means.

5. The electronic guitar of claim 4, wherein each of said manually actuatable means corresponds, in said lead mode, to a different predetermined variation in the pitch of the note sound.

6. The electronic guitar of claim 5, wherein each manually actuatable means varies the pitch of the note sound of said second music signal component by one-half step relative to the adjacent manually actuatable means for simulating the functioning of a conventional guitar.

7. The electronic guitar of claim 3, wherein said means for generating a music signal comprises, in an automatic mode, means for generating a music signal comprising a third music signal component corresponding to a predetermined progression of chord sounds; and means responsive to actuation of at least one of said strings for causing said music signal generating means to generate, in said automatic mode, the appropriate chord sound of said predetermined progression and wherein said first switch means comprises means for selecting as between said chord mode, said lead mode and said automatic mode.

8. The electronic guitar of claim 7, wherein actuation of any one of said strings causes said music signal generating means to generate, in said automatic mode, the appropriate chord sound of said predetermined progression.

9. The electronic guitar of claim 7, wherein said music signal generating means further comprises, in said automatic mode, means for generating one of a plurality of predetermined progressions of chord sounds; at least two of said manually actuatable means each corresponding, in said automatic mode, to a different one of said predetermined progressions of chord sounds, actuation of one of said at least two manually actuatable means in said automatic mode selecting the corresponding predetermined progression of chord sounds as the predetermined progression of chord sounds of the music signal.

10. The electronic guitar of claim 3, wherein said music signal generating means further comprises means responsive to a first activating signal for generating a music signal component corresponding to a background rhythm style, said background rhythm style being simultaneously generated with said chord sounds in said chord mode and with said note sounds in said lead mode; and further comprising second switch means on said housing for selectively providing said first activating signal to said music signal generating means.

11. The electronic guitar of claim 10, wherein said music signal generating means comprises means for generating one of a plurality of background percussion rhythms in response to said first activating signal, and means on said housing and connected to said music generating means for selecting one of said background percussion rhythms.

12. The electronic guitar of claim 1, wherein said means on said housing for selecting one of said background rhythm styles comprises at least two of said manually actuatable means, each corresponding to a different background rhythm style.

13. The electronic guitar of claim 10, further comprising means on said housing and connected to said music signal generating means for manually adjusting the tempo of said rhythm style.

14. The electronic guitar of claim 7, wherein said music signal generating means further comprises means for generating a music signal component corresponding to a background rhythm style, said rhythm style being generated automatically when said electronic guitar is in said automatic mode.

15. The electronic guitar of claim 7, wherein said music signal generating means further comprises means responsive to a second activating signal for generating a music signal component corresponding to a bass line; and further comprising third switch means on said housing for selectively providing said second activating signal to said music signal generating means.

16. The electronic guitar of claim 15, further comprising means on said housing for changing the key of the chord progression generated by said music signal generating means in said automatic mode.

17. The electronic guitar of claim 16, wherein said means for changing the key of the chord progression comprises said manually actuatable means, at least two of which correspond to different keys when said music signal generating means is in said automatic mode.

18. The electronic guitar of claim 16, wherein said music signal generating means further comprises means for automatically changing the key of the bass line for harmony with the selected key of the chord progression when said music signal generating means is in the automatic mode.

19. The electronic guitar of claim 15, further comprising means for automatically changing the key of the bass line for harmony with the selected chord root when said music signal generating means is in the chord mode.

20. The electronic guitar of claim 3, wherein said music signal generating means comprises means responsive to a third activating signal for bending the pitch of the notes in the lead mode and for muting the chord sounds in the chord mode, and further comprising a fourth switch means for selectively providing said third activating signal to said music signal generating means.

21. The electronic guitar of claim 7, wherein said music signal generating means comprises responsive to a third activating signal for bending the pitch of the notes in the lead mode and for muting the chord sounds in the chord mode and the automatic mode, and further comprising a fourth switch means on said housing for selectively providing said third activating signal to said music signal generating means.

22. The electronic guitar of claim 7, further comprising a speaker driven by said music signal and secured in said housing.

23. The electronic guitar of claim 22, wherein each of said manually actuatable means comprises a pushbutton having an enlarged head.

24. The electronic guitar of claim 23, wherein said plurality of strings comprises four strings and wherein said plurality of manually actuatable means comprises twelve manually actuatable means.

25. The electronic guitar of claim 22, further comprising means on said housing and connected to said music signal generating means for varying the volume of the sound output from the speaker.

26. The electronic guitar of claim 7, further comprising means on said housing and connected to said music signal generating means for altering the waveform and/or envelope of said music signal for varying the sound of said music signal without varying the pitch thereof.

27. An electronic guitar for generating a music signal for driving a speaker or the like, comprising:

a housing defining a neck and body;

a plurality of strings secured to the body;

microprocessor means mounted in the housing and responsive to actuation of the strings for generating, in a chord mode, a music signal corresponding to one of plurality of chords sounds, each of said chords being defined by a chord root, and in a lead mode, a music signal corresponding to one of a plurality of notes;

a plurality of pushbuttons connected to said music signal generating means and distributed along the neck for selecting, in said chord mode, the chord root of said music signal, each pushbutton corresponding, in said chord mode, to a different chord root, actuation of one of said pushbuttons selecting the corresponding chord root as the chord root of the music signal, and for selecting, in said lead mode, the pitch of the note comprising the music signal, each of said pushbuttons corresponding, in said lead mode, to a different predetermined variation in the pitch of the note, there being only one pushbutton for each fret position, depression of one of said pushbuttons selecting the corresponding pitch variation as the pitch variation of the note comprising the music signal for any one of said plurality of strings when any one of said plurality of strings is actuated; and a first switch means mounted on said housing for selecting between said chord mode and said lead mode.

28. The electronic guitar of claim 27, wherein chord sound is further defined by a chord type, and wherein said microprocessor means further comprises, in said chord mode, means responsive to actuation of said strings for selecting the chord type of said music signal, each of said strings corresponding to a different chord type, actuation of one of said strings selecting the corresponding chord type as the chord type of the music signal when one of the said pushbuttons depressed.

29. The electronic guitar of claim 27, wherein said microprocessor means comprises means for generating the selected chord sound upon actuation of any one of said strings.

30. The electronic guitar of claim 27, wherein each pushbutton varies the pitch of the note by one-half step relative to the adjacent pushbuttons for simulating a conventional guitar.

31. The electronic guitar of claim 27, wherein said microprocessor means comprises, in an automatic mode, means for generating a music signal comprising a predetermined progression of chord sounds, said microprocessor means generating, in said automatic mode, the appropriate chord sound of said predetermined progression upon actuation of the strings; and wherein said first switch means comprises means for selecting as between said chord mode, said lead mode and said automatic mode.

32. The electronic guitar of claim 31, wherein said microprocessor means, in said automatic mode, generates said appropriate chord sound upon actuation of any one of the strings.

33. The electronic guitar of claim 31, wherein each pushbutton, in said automatic mode, corresponds to a different key for said chord progression, and wherein said microprocessor means, upon depression of one of said pushbuttons, changes the key of the chord progression to the key corresponding to the depressed pushbutton.

34. The electronic guitar of claim 31, wherein said microprocessor means further comprises, in said automatic mode, means for generating one of a plurality of predetermined progressions of chord sounds; at least some of said pushbuttons each corresponding, in said automatic mode, to a different one of said predetermined progressions, depression of one of said at least some pushbuttons in said automatic mode selecting the corresponding predetermined progression of chord sounds as the predetermined progression of chord sounds of the music signal.

35. The electronic guitar of claim 31, wherein said microprocessor means further comprises means responsive to a first activating signal for generating, as part of said music signal, a background rhythm style, said rhythm style being simultaneously generated with said chord sounds in said chord and automatic modes, and with said note sounds in said lead mode; and further comprising second switch means on said housing for providing said first activating signal to said microprocessor means.

36. The electronic guitar of claim 35, wherein said microprocessor means further comprises means for generating a plurality of background rhythm styles, at least some of said pushbuttons each corresponding, in said chord and lead modes, to one of said plurality of rhythm styles, one of said rhythm styles being selected by depressing one of said at least some pushbuttons while said second switch means is activated for providing said first activating signal to said microprocessor means.

37. The electronic guitar of claim 35, further comprising means on said housing and connected to said microprocessor means for manually adjusting the tempo of said rhythm style.

38. The electronic guitar of claim.-31, wherein said microprocessor means further comprises means responsive to a second activating signal for generating, as part of said music signal, a bass line; and further comprising third switch means on said housing for providing said second activating signal to said microprocessor means.

39. The electronic guitar of claim 33, wherein said microprocessor means further comprises means responsive to a second activating signal for generating, as part of said music signal, a bass line; and further comprising third switch means on said housing for providing said second activating signal to said microprocessor means.

40. The electronic guitar of claim 39, wherein said microprocessor means further comprises means for automatically changing the key of the bass line for harmony with the selected key of the chord progression when the microprocessor means is in the automatic mode.

41. The electronic guitar of claim 38, further comprising means for automatically changing the key of the bass line for harmony with the selected chord root when said microprocessor means is in the chord mode.

42. The electronic guitar of claim 31, wherein said microprocessor means comprises means responsive to a third activating signal for bending the pitch of the notes in the lead mode and for muting the chord sounds in the chord and automatic modes, and further comprising a fourth switch means for selectively providing said third activating signal to said microprocessor means.

43. The electronic guitar of claim 27, further comprising a speaker driven by said music signal and secured in said housing.

44. The electronic guitar of claim 27, wherein each pushbutton has an enlarged head.

45. The electronic guitar of claim 27, wherein said plurality of strings comprises four strings and wherein said plurality of pushbuttons comprises twelve pushbuttons.

46. The electronic guitar of claim 43, further comprising means on said housing and connected to said microprocessor means for varying the volume of the sound output from the speaker.

47. The electronic guitar of claim 27, further comprising means on said housing and connected to said microprocessor means for altering the waveform and/or the envelope of said music signal for varying the sound of said music signal without varying the pitch thereof.

* * * * *